US005482072A

United States Patent [19]

Cimino

[11] Patent Number: 5,482,072

[45] Date of Patent: Jan. 9, 1996

[54] VERSATILE AND UNIVERSAL HANDLE

[76] Inventor: Thomas C. Cimino, 25706½ Eshelman Ave., Lomita, Calif. 90717

[21] Appl. No.: 169,431

[22] Filed: Dec. 17, 1993

[51] Int. Cl.[6] ..... A61H 3/02

[52] U.S. Cl. ..... 135/72; 135/76

[58] Field of Search ..... 135/65, 72, 76; 30/340, 308.1; 81/20

[56] References Cited

U.S. PATENT DOCUMENTS

| | | | |
|---|---|---|---|
| 489,511 | 1/1893 | Terpening | 30/308.1 X |
| 1,600,046 | 9/1926 | Goldwin | 135/76 |
| 2,846,277 | 8/1958 | Marsh | 81/20 X |
| 3,115,912 | 12/1963 | Harris | 81/20 |
| 3,252,489 | 5/1966 | Huston et al. | 30/308.1 |
| 3,545,755 | 12/1970 | Owada . | |
| 3,770,033 | 11/1973 | Gavillet et al. . | |
| 4,038,719 | 8/1977 | Bennett . | |
| 4,121,605 | 10/1978 | Schmerl | 135/65 |
| 4,759,546 | 7/1988 | Steele, Jr. . | |
| 4,796,648 | 1/1989 | Goulter . | |
| 4,890,837 | 1/1990 | Keeler . | |
| 4,958,650 | 9/1990 | Dale . | |
| 5,058,902 | 10/1991 | McCutchen . | |
| 5,287,870 | 2/1994 | Rhodes | 135/65 X |

OTHER PUBLICATIONS

Ian Chong, et al., The Human Factor, May/Jun. 1983, pp. 30–32.

*Primary Examiner*—Lanna Mai

*Attorney, Agent, or Firm*—Poms, Smith, Lande & Rose

[57] ABSTRACT

The Versatile and Universal Handle has a bilaterally symmetrical, curvilinear shape of predetermined proportions with a tapered, variable grip. The handle includes a proximal gripping area, an intermediate area, and a distal area. The proximal gripping area preferably makes an angle of between eight degrees and fifteen degrees with respect to the intermediate area. The intermediate area preferably makes an angle of approximately one degree to five degrees with respect to the distal area. These three areas flow smoothly in transition from one to the next. In cross-section the handle appears as an ellipse with its exact shape, eccentricity, and size varying considerably with position along the major axis. The cross-sectional shape through the mid-section of the proximal gripping ares is very near circular with a markedly smaller cross-sectional area than at either end of the proximal gripping area. The Versatile and Universal Handle, by means of its unique shape, promotes correct posture and ergonomically correct patterns of movement. Further, the prominent arch of the handle in combination with its overall unique shape creates a substantial contact surface area that conforms to a natural grip of the hand. The handle may be used in different hand positions including a reversed grip. The handle, designed for use on a long cane for the blind, is applicable to other implements, including weight bearing and support devices.

21 Claims, 4 Drawing Sheets

Figure 2a TOP VIEW

Figure 2b SIDE VIEW

Figure 2c CROSS-SECTIONS ABOUT MINOR AXES

VERSATILE AND UNIVERSAL HANDLE

FIELD OF THE INVENTION

This invention relates to a versatile handle which may be used for many purposes including handles for staffs for use by the blind.

BACKGROUND OF THE INVENTION

The staff may be the oldest multi-purpose tool known to man. In addition to serving as an aid in mobility, the staff has also been modified to serve many other purposes. Until modern times, staffs that were designed for support have also served as the primary probing tool for use by the blind.

Today, the "long cane" is the most common probing tool in use by the blind. These canes are not used for weight bearing or support. The long cane, and the sophisticated foot travel technique associated with it, dates back to organized rehabilitative efforts developed for returning veterans blinded in WWII. It was found that by lengthening and lightening the traditional crook-handle support cane or staff, sweeping probing techniques could be used. Blind persons could extend the "long cane" outward as a tool, while moving it in sweeping arcs form side-to-side for exploring terrain.

The gripping areas of long canes are generally based on some variant of a circular grip or a golfer's putter grip adapted for use on a straight-axis circular shaft. Specifications of the long cane with a crook-handle may be found in *Foundations in Orientation and Mobility,* American Foundation for the Blind, 1987. When the traditional crook-handle support cane was lengthened, the straight circular shaft adjacent to the crook was able to serve as the gripping area. In usage, the crook of the handle was oriented downwards and served as a counter-balance for the shaft. The crook-handle has disappeared on many models of long canes, and commonly the straight-axis putter and circular grips serve without the counter-balance of the crook.

There are functional problems heretofore with circular, specialized, and adapted designs of long cane grips. The grips lack a practicable shape and distribution of mass that allows an effective method of counter-balancing for comfort and control. The grips lack an effective shape for optimum overall usage, and more specifically, they lack a versatility for use in both extended and upright positions.

The shape of the grips, with the exception of a custom-designed malleable plastic grip molded for a specific person's hand, causes a maladaptive deviation of the wrist that promotes a chain reaction of harmful effects including improper postural alignment and fatigue. The basic problem with the circular and straight-axis grips found on long canes is that when firmly grasped and manipulated they force the wrist into an abnormal position, a deviation from a straighter alignment that is preferable for manipulation of a tool.

Specialized grips for long canes are those grips which have been customized by actually molding the grip to the shape of the hand. A disadvantage of this technique is that the grip lacks versatility. Because the fight and left hands have a different dexterity, and because they may not be exactly identical in shape, a molded personal grip is limited to one hand. In addition, the use of finger grooves on molded grips can cause problems for persons whose hands do not fit the grooves.

Adapted grips are grips which have been adapted from other uses to be used on long canes. Each adapted grip has unique problems. For example, curved ax handles have been tried on long canes. Curved ax handles have a similar slant as the Versatile and Universal Handle, but they have a distinctly different cross-sectional configuration, and in particular they are narrower. Firmly grasping a curved ax handle causes the wrist to deviate from a straight position and the hand enters into a locked upraised grip. The constant usage pattern of the long cane creates the need for allowing a more neutral position of the wrist that accommodates a pattern of movements including a frequent tapping, lifting, and sweeping from side to side. Because of this, a common curved ax handle is not appropriate for these sweeping patterns of movement.

The golfer's putter grip is a very common adapted long cane grip. The putter grip has a flat area designed for placement of the thumbs on top of the grip. This putter grip has been adapted for use on the long cane by orienting the flat area to the side for placement of the index finger. This usage, however, increases the repetitive use of the index finger. An ergonomic design guideline is to minimize the repetitive use of the index finger for manipulation and rely more on the thumb if possible. The muscles that control the thumb are particularly well suited for manipulation of a tool. The index finger is not as well suited for tool manipulation, but is effective in interpreting vibration and also in gently controlling the stroke of the long cane. The excessive use of the index finger for gross manipulation not only causes fatigue, but this pattern diminishes the capability of the index finger to be used for interpreting vibrations and other more appropriate sensory functions. Details of preferred hand positions may be found in *Human Factors in Engineering and Design* by Sanders and McCormick.

Another problem with the putter grip is that the relatively small contact surface area of the grip, when it is adapted to long cane use, creates pressure points on the hand. An ergonomic design guideline is to provide a substantial contact surface area to distribute pressure on the hand more evenly, wherein handling of a tool or other implement is more comfortable and less stressful.

For a variety of implements, there have been many attempts to achieve a proper alignment of the wrist by changing the bend or angle of attachment of a commonly used grip. This has been tried on such devices as hammers, crutches, and ski poles. But it has been found that, in addition to the bend of a handle and its angle of attachment, the cross-sectional shape of the surface being gripped determines the position of the wrist when a handle is firmly grasped.

Accordingly, the principal objects of the claimed invention are to provide an improved handle with a shape that promotes correct posture and ergonomically correct patterns of movement; to provide a handle with a substantial contact surface area that conforms to a natural grip of the hand; to provide a handle that allows a firm yet relaxed grip that does not unnecessarily tense the muscles and restrict the range of movement; to provide a handle that accommodates use by both hands yet also accommodates the special dexterity of each hand; to provide a handle that allows a natural alignment of the hand which does not force the skeletal structure to lose its optimum efficiency as a support; to provide a handle that allows the muscles to move the body more easily; to provide a handles that does not hasten fatigue; to provide a handles that does not require excessive manipulation of the index finger, yet allows the index finger to be properly used for tactile interpretation and control. It is yet a further objective to provide a handle with a practicable shape and distribution of mass that allows an effective method of counter-balancing. Also it is an objective of the invention to provide a handle with a versatile and universal design that may be used in different orientations for special or combined purposes, including use as a probing and support device that helps a person move about and explore the environment.

BRIEF SUMMARY OF THE INVENTION

In accordance with the present invention, a Versatile and Universal Handle ("handle"), by means of its variably tapered complex curvilinear shape, is a universal design that promotes correct posture and ergonomically correct patterns of movement. The handle, designed for use on a long cane, is applicable to mobility devices in general for handicapped persons, and also applicable to a tool or other implement to aid all persons at work, at home, and in recreational pursuits.

The handle allows a firm yet relaxed grip that does not unnecessarily tense the muscles, restrict the range of movement, or hasten fatigue. The handle places minimal stress on the index finger, and allows the index finger to be properly used for tactile interpretation and control. The handle has a practicable shape and distribution of mass that allows an effective method of counter-balancing. The handle may be used for a tool, or for a probing or support device that helps a person move about and explore the environment.

More specifically, the Versatile and Universal Handle has a bilaterally symmetrical, curvilinear shape of predetermined proportions and includes a proximal gripping area, an intermediate area, and a distal area. The distal area intercouples the intermediate area with a tool appropriate to a particular task. For example, the tool may be an elongated shaft, a long cane, a mobility device, a mechanical tool such as a claw hammer, or recreational equipment such as a fishing pole, or a ski pole.

The proximal gripping area preferably makes an angle of between eight degrees and fifteen degrees with respect to the intermediate area. The intermediate area preferably makes an angle of approximately one degree to five degrees with respect to the distal area. The handle when firmly gripped in the forward or reverse orientation and manipulated promotes correct posture and ergonomically correct patterns of movement for a variety of tasks.

The preferred embodiment of the invention may also include the following additional features:

1. a substantial contact surface area that conforms to a natural grip of the hand;
2. a shape that promotes correct posture and ergonomically correct patterns of movement;
3. a shape that allows a firm yet relaxed grip that does not unnecessarily tense the muscles and restrict the range of movement;
4. a shape that accommodates use by both hands yet also accommodates the special dexterity of each hand;
5. a shape that allows a natural alignment of the hand which does not force the human skeletal structure to lose its optimum efficiency as a support;
6. a shape that allows the muscles to move the body more easily;
7. a shape that does not hasten fatigue;
8. a shape that does not require excessive manipulation of the index finger, yet allows the index finger to be properly used for tactile interpretation and control;
9. a shape that is practicable and has distribution of mass that allows an effective method of counter-balancing; and
10. a shape that has a universal design that may be used in different orientations for special or combined purposes, including use as a probing and support device that helps a person move about and explore the environment.

Finally, the Versatile and Universal Handle may include a proximal gripping area with the intermediate and distal areas significantly reduced in size or nonexistent. The proximal gripping area would have a ratio of height to width taken at substantially 12% of the length and from the outer end of the proximal gripping area of substantially 1.35, at substantially 25% of the length from the outer end of the proximal gripping area the ratio is substantially 1.19, at substantially 50% of the length from the outer end of the proximal gripping area the ratio is substantially 1.08, at substantially 75% of the length from the outer end of the proximal gripping area the ratio is substantially 1.06, and at the inner end of the proximal gripping area the ratio is substantially 1.10.

Other objects, features and advantages of the present invention will become apparent from a consideration of the following detailed description, and from the accompanying drawings.

DETAILED DESCRIPTION OF THE PREFERRED EMBODIMENT

Figure 1:
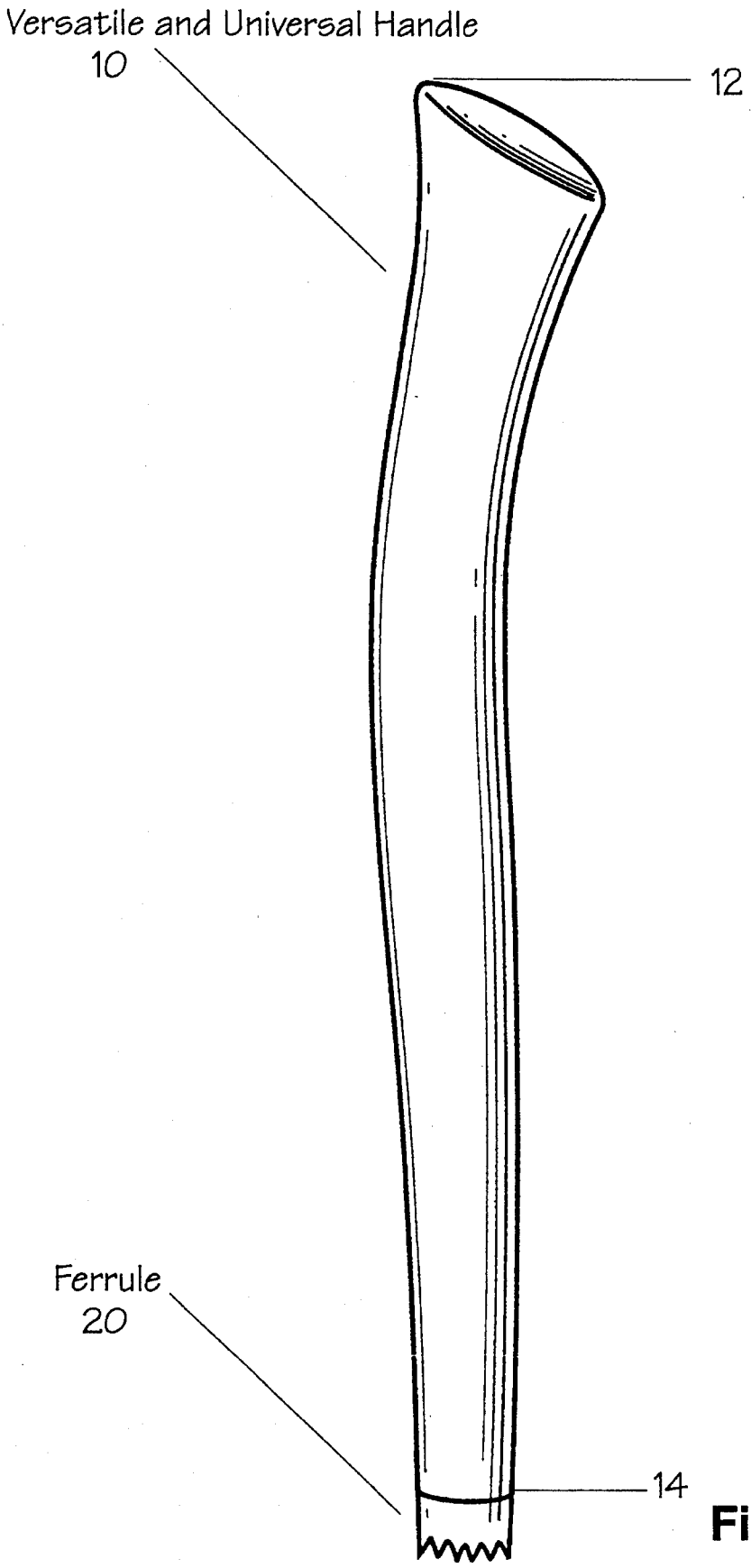
FIG. 1 is a view of the Versatile and Universal Handle.
Figure 2:
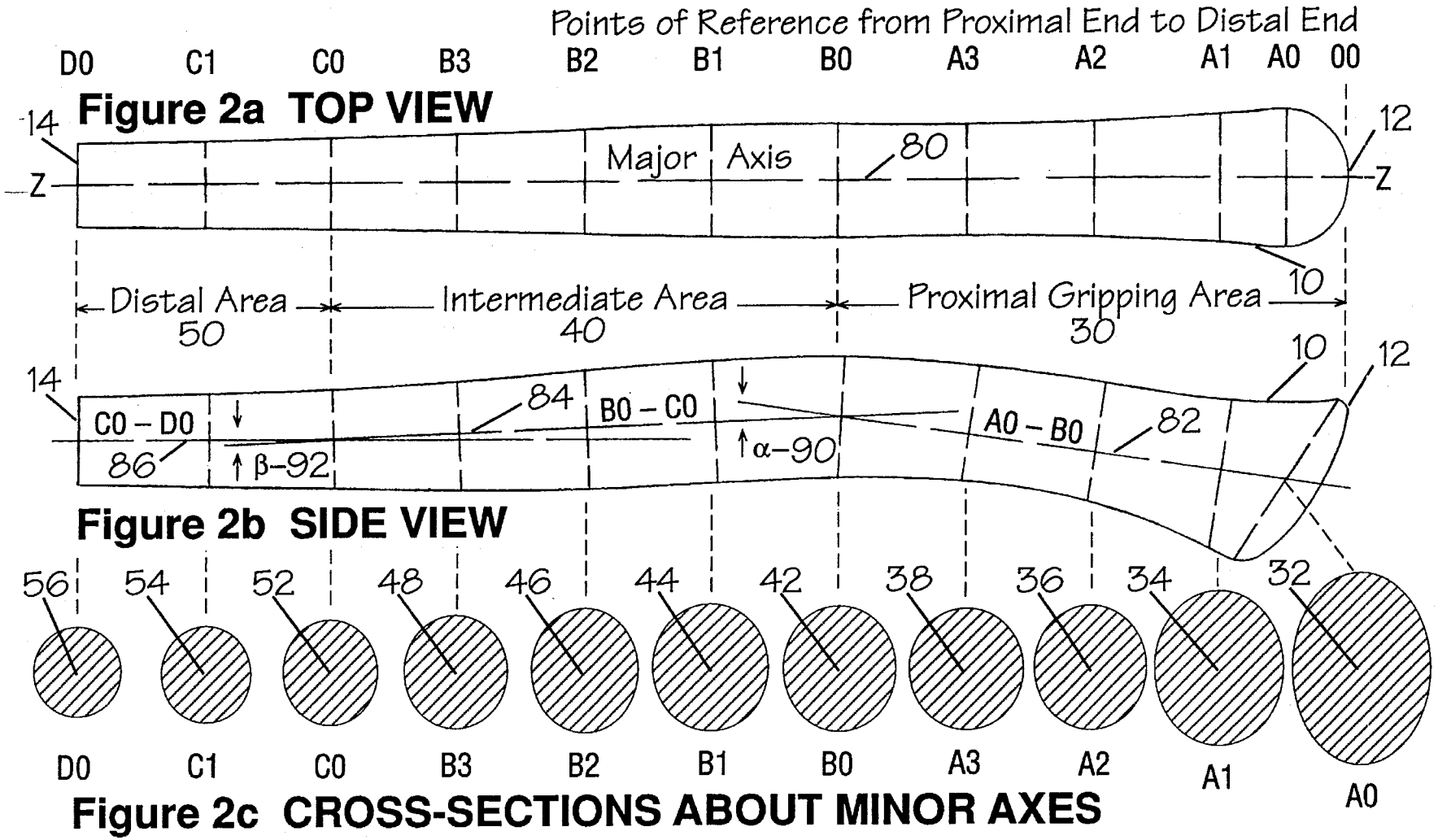
FIG. 2*a* is a top view of the Versatile and Universal Handle with indicated points of reference corresponding to cross-sections and showing the major, straight axis.
FIG. 2*b* is a side view of the Versatile and Universal Handle with indicated points of reference corresponding to cross-sections and showing the three minor axis.
FIG. 2*c* is the cross-sections about the minor axis of the Versatile and Universal Handle at the points of reference indicated by FIG. 2*a* and FIG. 2*b;*
Figure 3:
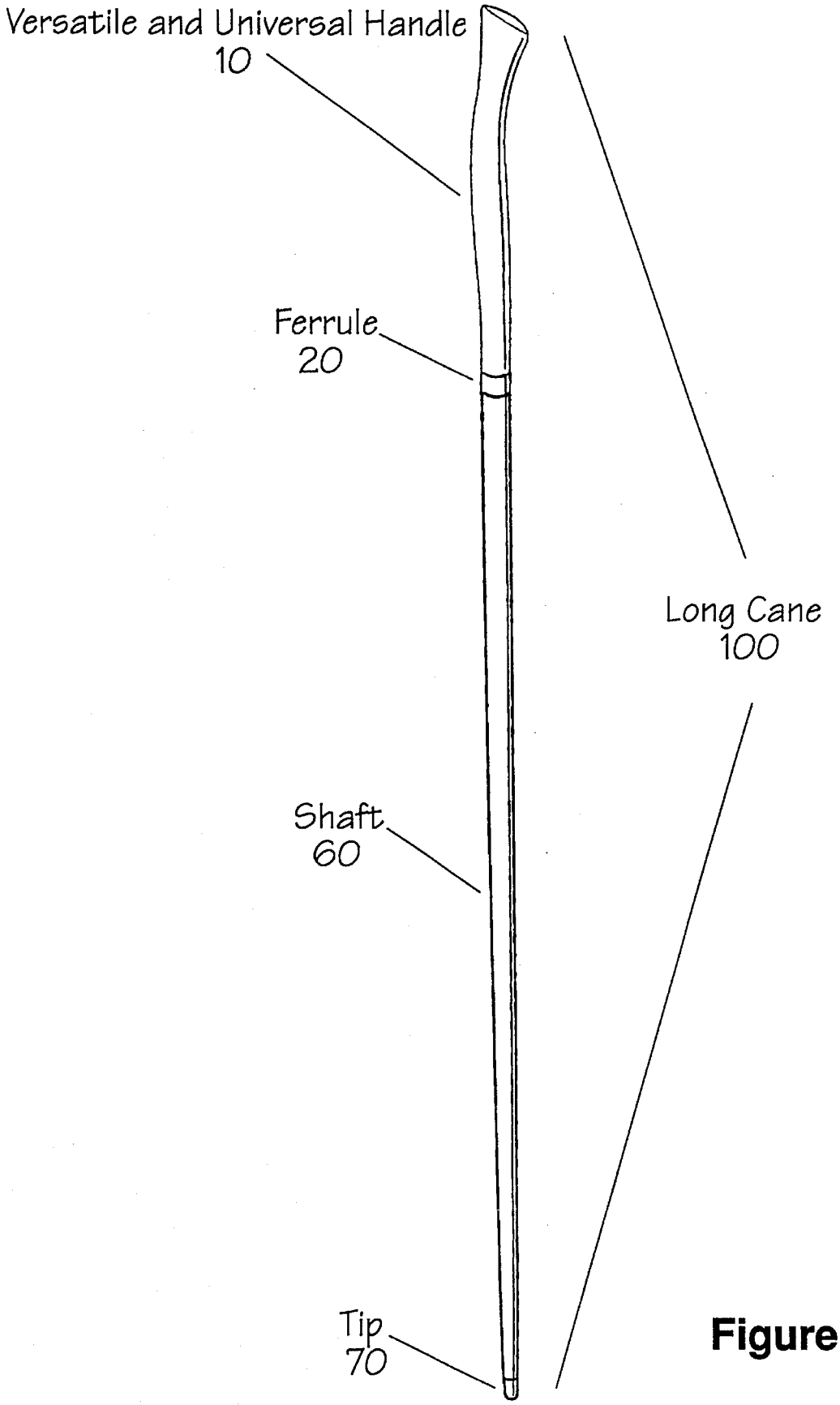
FIG. 3 is a side view of the Versatile and Universal Handle attached to a shaft for use as a long cane.

Referring more particularly to the drawings, FIG. 1 and FIGS. 2*a*, 2*b*, and 2*c* are depictions of a Versatile and Universal Handle ("handle") 10 having a symmetrical, curvilinear shape of predetermined proportions with a tapered variable grip 30 and 40. The constantly changing curvilinear handle 10 tapers into a generally circular cross-sectional shape 56 at the distal end 14. The Versatile and Universal Handle 10 is described as having a variably-tapered-complex-curvilinear shape because the cross-sectional shape varies along the handle 10, the circumference varies along the handle and because the curvature varies along the handle (FIG. 2*c*). A ferrule 20 which is a ring of sturdy material such as metal or plastic may be included at the distal end 14 of the handle 10 to strengthen or support the shaft 60. (FIG. 3) A tip 70 may also be included at the end opposite the handle 60.

As shown in FIGS. 2*a*, 2*b*, and 2*c*, points of reference along the handle 10 have been indicated for purposes of description. These points of reference are measured from the proximal end 12 to the distal end 14. Beginning at the proximal end the points of reference proceed as follows: 00 12 at 0.0 inches; A0 32 at 0.6 inches; A1 34 at 1.25 inches; A2 36 at 2.5 inches; A3 38 at 3.75 inches; B0 42 at 5.0 inches; B1 44 at 6.25 inches; B2 46 at 7.5 inches; B3 48 at 8.75 inches; C0 52 at 10.0 inches; C1 54 at 11.25 inches; and DO 56 at 12.5 inches. These dimensions are meant to be exemplary and are not meant to limit the invention in any way. For example, these dimensions could be increased proportionally to conform to the hand of a larger user or decreased proportionally to conform to the hand of a smaller user.

For further purposes of description, in FIG. 2*a* and 2*b* the handle 10 has been divided into three sections which flow smoothly from one section to the next:

(1) the proximal gripping area 30 measuring approximately 5 inches from points of reference 00 12 to B0 42; (2) the intermediate area 40 measures approximately 5 inches from points of reference B0 42 to C0 52; and (3) the distal area 50 measures approximately 2.5 inches from points of reference C0 52 to D0 56.

FIG. 2*a* is a top view of the-Versatile and Universal Handle 10. The handle, as shown here, is bilaterally symmetrical about the Major Axis Z-Z 80 which appears as a dashed line bisecting the handle. The cross-sections in FIG. 2*c* are normal to the Major Axis Z-Z 80 as shown at points of reference along the handle 10.

FIG. 2*b* is a side view of the Versatile and Universal Handle 10. The handle, as shown here, can be described with three Minor Axes 82, 84, and 86 as shown by dashed lines. The axis through the proximal gripping area 30 is described by a line 82 which connects the midpoints of the cross-sections at A0 32 and B0 42. The axis through the intermediate area 40 is described by a line 84 which connects the midpoints of the cross-sections at B0 42 and C0 52. The axis through the distal area 50 is described by a line 86 which connects the midpoints of the cross-sections at C0 52 and D0 56.

The angle of incidence from axis A0–B0 82 to axis B0–C0 84, is identified as α 90, is approximately 11.25 degrees. The angle of incidence from axis B0–C0 84 to axis C0–D0 86, identified as β 92 is approximately 2.75 degrees. These angles are exemplary, and are not meant to limit the invention in any way. For example, α may vary between eight (8) degrees and fifteen (15) degrees. β may vary between one (1) degree and five (5) degrees.

The cross-section shown at reference point A0 32 on FIG. 2*b* is parallel to the proximal end 12. The cross-sections shown at the intersecting points B0 42 and C0 52 are normal to an imaginary line which bisects their respective angles of incidence. The cross-section shown at all other points of reference on FIG. 2*b* are normal to their respective axes.

The cross-sectional shapes (32, 34, 36, 38, 42, 44, 46, 48, 52, 54, and 56) of the handle are shown on FIG. 2*c*. These cross-sectional shapes were obtained by taking impression molds on a prototype handle at all points of reference across the minor axes of FIG. 2*b*. Stamped images of these cross-sections were scanned and approximated with best fit elliptical shapes and the resulting shapes are shown as FIG. 2*c*.

Of particular note, the cross-sectional shapes through the middle of the proximal gripping area 30, between reference points A2 36 and A3 38, is nearly circular and smaller in diameter than adjacent portions of the handle. In contrast, the cross-sectional shape through the intermediate area 40, particularly between reference points B1 44 and B3 48, is noticeably out-of-round where the top-to-bottom height is greater than the side-to-side width. Further, the cross-sectional shape through the distal area 50, from reference points C0 52 through D0 56, progressively approaches a circular shape.

FIGS. 2*a*, 2*b*, and 2*c* also detail the dimensions and ratios of the handle 10. More specifically, the prototype of the handle 10, as shown in FIGS. 2*a* and 2*b*, is approximately 12.5 inches in length from reference point 00 at the proximal end 12 to reference point D0 at the distal end 14. On the prototype handle, the measurements across the Major Axis 80 and Minor Axes 82, 84, and 86 were calculated to a thousandth of an inch and rounded to a hundredth of an inch. It should be noted that these are measurements of a prototype or a preferred embodiment of the invention and therefore, the measurements are meant to be exemplary and are not meant to limit the invention in any way.

The approximate width in inches across the Major Axis Z-Z 80 of the prototype handle and as shown in FIG. 2*a*, for each point of reference is as follows: A0 is 1.41; A1 is 1.29; A2 is 1.13; A3 is 1.12; B0 is 1.13; B1 is 1.13; B2 is 1.09; B3 is 1.01; C0 is 0.93; C1 is 0.87; and D0 is 0.83. These dimensions are meant to be exemplary and are not meant to limit the invention in any way. For example, these dimensions could be increased proportionally to conform to the hand of a larger user or decreased proportionally to conform to the hand of a smaller user.

The approximate height in inches across the Minor Axes 82, 84, and 86 of the prototype handle and as shown in FIG. 2*b*, for each point of reference is as follows: A0 is 1.91; A1 is 1.53; A2 is 1.22; A3 is 1.19; B0 is 1.24; B1 is 1.26; B2 is 1.21; B3 is 1.12; C0 is 1.03; C1 is 0.96; and D0 is 0.89. These dimensions are meant to be exemplary and are not meant to limit the invention in any way. For example, these dimensions could be increased proportionally to conform to the hand of a larger user or decreased proportionally to conform to the hand of a smaller user.

The approximate nondimensional ratio of the height to the width for each point of reference along the handle 10 is as follows: A0 is 1.35; A1 is 1.19; A2 is 1.08; A3 is 1.06; B0 is 1.10; B1 is 1.12; B2 is 1.11; B3 is 1.11; C0 is 1.11; C1 is 1.10; and D0 is 1.07. These ratios are meant to be exemplary and are not meant to limit the invention in any way.

It is also noted that the configuration of the proximal gripping area per se is considered to be significant, and it may be defined as follows, using a generalization of the dimensions previously set forth. More specifically, and with reference to FIGS. 2*a*, 2*b*, and 2*c*, the proximal gripping area has a ratio of height to width taken at substantially 12% of the length from the outer end of the proximal gripping area of substantially 1.35, at substantially 25% of the length from the outer end of the proximal gripping area the ratio is substantially 1.19, at substantially 50% of the length from the outer end of the proximal gripping area the ratio is substantially 1.08, at substantially 75% of the length from the outer end of the proximal gripping area the ratio is substantially 1.06, and at the inner end of the proximal gripping area the ratio is substantially 1.10.

It is further noted that the outer or butt end of the proximal gripping area could be carved into or provided with an ornamental design. In such cases, the "outer end" of the proximal gripping area shall be construed as excluding such additional ornamentation.

It should be noted that the above measurements are specific to the prototype handle which is 12.5 inches in length from the proximal end 12 to the distal end 14. The handle may, however, vary in length to a minimum of approximately five (5) inches which would include primarily the proximal gripping area and a substantially shortened or nonexistent version of the intermediate and distal areas. Further, the handle may be attached to an implement at an angle that is appropriate for the intended use. In addition, the shape of the cross-sections through the intermediate and distal areas may be made more circular or elliptical, or otherwise modified while maintaining the other predetermined proportions and characteristics of the variable, tapered shape of the handle through the proximal gripping area. Also, the butt end of the proximal gripping area from points of reference 00 12 to A0 32 may be rounded, flattened, decoratively carved, or otherwise modified without substantially altering the gripping area.

The handle 10 may be attached to a shaft or other implement by means of a shank (not shown) which may extend approximately to 6 inches out from the distal end 14 of the handle. The shank should be an integral part of the handle body with a cross-section that conforms to that of the distal end. The diameter of the shank should be suitably smaller than the smallest diameter of the distal end 14 of the handle 10 so that a sufficient shelf exists to provide a mating surface for the staff. The shank may be inserted into a mating cavity inside the shaft after the application of an appropriate adhesive. A ferrule 20 may be added for strength or to aid in the attachment process. A variety of other attachment methods known in the art may also be used for example fastening devices such as screws, tapes, and soldering. The handle may also be made detachable.

The handle 10 may be fabricated from any sturdy material which is suitable for the intended use of the handle. Such materials may include, for example, wood, metal, plastic, reinforced plastic, or any combination of these materials. Useful types of woods include but are not limited to ash, walnut, and oak. White ash is preferred due to the texture of the grain for gripping, high strength to weight ratio, sensitivity, and shock absorbing characteristics. Plastics may be reinforced or suitably strengthened.

The core of the handle 10 may be solid or hollow in order to modify weight, balance, or accommodate the insertion of an electronic device or telescoping rod. If a hollow core is used, it may be filled with vermiculite, perlite, wood shavings, or wood pulp. The use of a packing material to fill the core is desirable in order to attenuate shock originating from the shaft. Metal or ceramic powders or pellets may be inserted at various points into the handle in order to optimize balance for attachment of a specific staff or other implement.

Fabrication methods for the handle 10 include but are not limited to carving, molding, or casting.

Operation of the handle 10 may be accomplished by a variety of one- and two-handed positions that may be employed in different types of movement and their applied forces. Some typical movements accommodated by the handle include, but are not limited to, side-to-side, fore-and-aft, push-and-pull, rotational, swinging, lifting, and tapping. The unique taper of the handle also allows a graded variety of hand positions.

Figure 6:
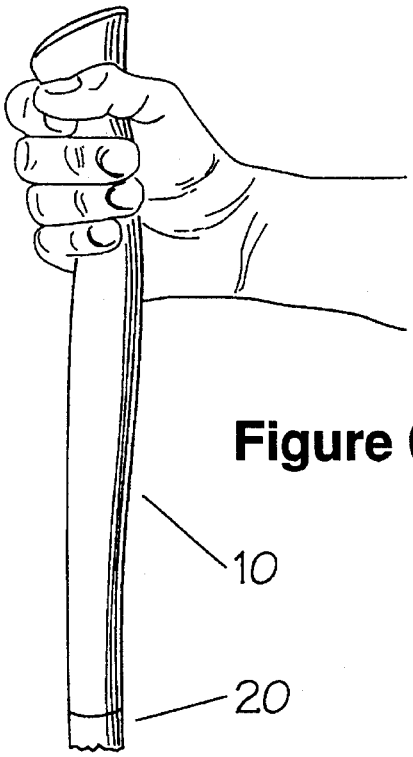
FIG. 6 is a side view of the Versatile and Universal Handle illustrating a hand position that may be used for balance and support.
Figure 4:
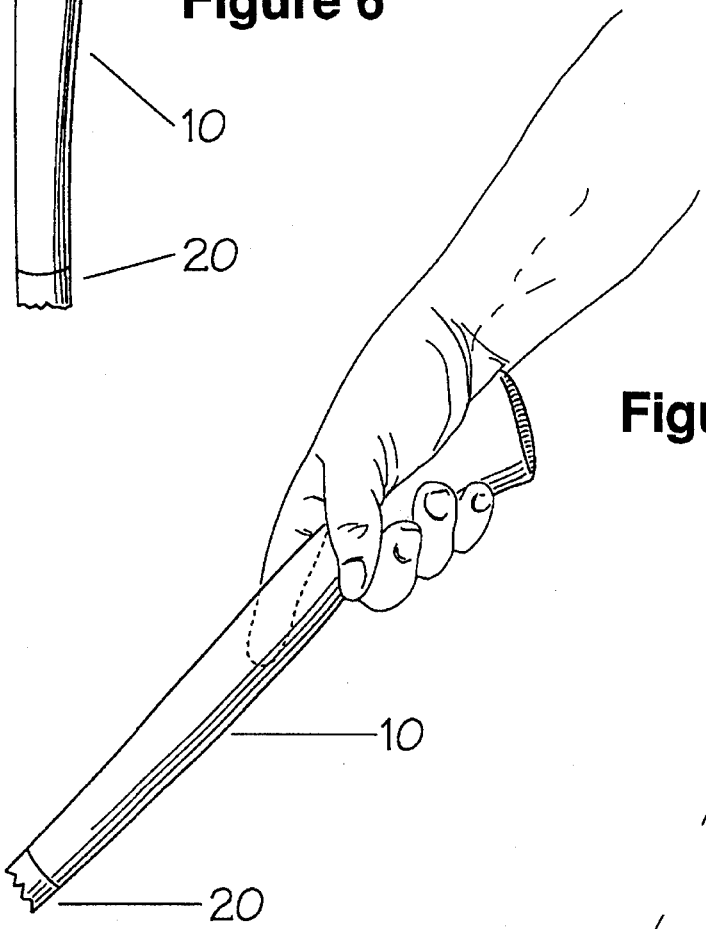
FIG. 4 is a side view of the Versatile and Universal Handle illustrating a hand position that may be used for continuous ground contact.
Figure 5:
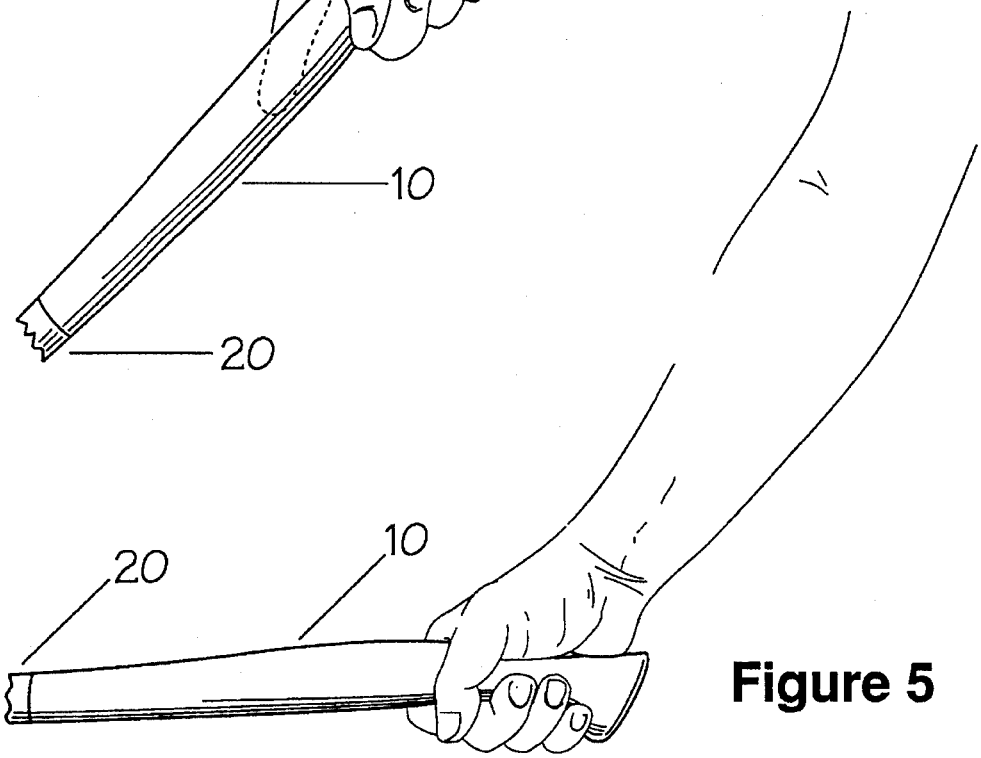
FIG. 5 is a side view of the Versatile and Universal Handle illustrating a hand position that may be used for lifting and tapping.

Three of the more basic hand positions are illustrated in FIGS. 4, 5, and 6. FIG. 4 represents a hand position that may be used in the continuous ground contact method of probing. FIG. 5 represents a hand position that may be used for lifting and tapping. FIG. 6 represents a reversed hand position that may be used for upright probing, balance and support, and use of the upper body to assist in propulsion.

In these hand positions, including the reversed grip shown in FIG. 6, the shape of the handle 10 fits naturally into the contour of the hand. The grip is firm yet relaxed. The handle 10 allows a range of hand movement from a normal, neutral, generally straight alignment of the wrist when the handle is firmly grasped and manipulated.

The thumb is primarily used for manipulation and the middle finger aids in stabilization and control. To some extent, all the fingers of the hand may aid in manipulation and control. The handle allows a light touch for the index finger. In FIGS. 5 and 6 the thumb locks over the index finger. In this manner, the index finger is firmly held to the staff, yet is not particularly tensed. In all the illustrations, the index finger is the least tensed digit of the hand.

In FIG. 4 the index finger is extended and has a considerable freedom to move. Because the index finger is not excessively involved in manipulation, it is free to tactilely interpret and aid in control, especially for more finely graded types of movement. The hand approximates a position that is found in normal walking without the use of any implement. Since the tip 70 (shown in FIG. 3) of the staff 100 is on the ground, this relaxed method of probing allows a more normal, tension-free manner of walking. In addition to established lateral sweeping techniques, this hand positioning allows a more diagonal and forward sinuous pattern of probing movement that naturally adapts to the reciprocal movement of the limbs. This accommodates a more natural stride. The wrist can be maintained in a comfortable position while the whole body aids in manipulating the staff. This position also allows the wrist to be kept straight while rotating the forearm and hand.

FIG. 5 represents a less strenuous hand position that may be used for lifting and tapping. This hand position allows an ease in manipulation of the tip 70 of the staff from the ground to an overhead orientation. In this hand position, the outer muscular edge of the hand is situated somewhat diagonally across the gripping area of the staff 100. Along with the tough tissue between the thumb and forefinger, this area of the hand buttresses some of the force that is generated in tapping. In this manner, the more tender area of the inner palm is somewhat more protected during forceful tapping. In addition to use for a long cane, this hand position is suitable for use with other implements and tools such as walkers, canes, crutches, cooking utensils, fishing poles, and hammers.

FIG. 6 represents a hand position that may be used for balance and support, upper body assistance for propulsion, or for upright probing while in a stationary position. The placement of the hand in this position is a reversal of the grips shown in FIGS. 4 and 5. This position of the hand is more common for other devices such as walking staffs and ski poles that are primarily used for balance, support, and mobility as well as propulsion, but that also may be used for probing while in a stationary position. This reverse grip for a claw hammer is suitable for pulling nails.

The hand position represented in FIG. 6 provides support in walking as well as enhancing balance. The handle 10, when used in this position for walking promotes a more correct pattern of movement for both hand and body. Although this grip is reversed from the positions shown in FIGS. (4) and (5), this orientation also allows a range of hand movement from a normal, neutral, generally straight alignment of the wrist when the handle is firmly grasped and manipulated in walking.

In general, the natural reciprocal movement of the arms and legs that occurs in walking does not develop properly in congenitally blind people. Use of the handle by the blind in this upright orientation, especially with the use of a staff in each hand, may help to promote the development of proper body movements found in walking.

In conclusion, it is to be understood that the present invention is not to be limited to that precisely as described hereinabove and as shown in the accompanying drawings. More specifically, the handle may be used as a handle for a variety of tools and devices including the long cane, any mobility device, mechanical tools, cooking utensils, or sporting and recreational equipment; the dimensions given could be increased or decreased to accommodate very small or very large hands; the α angle of incidence may vary between eight degrees and fifteen degrees; the β angle of incidence may vary between one degree and five degrees; the shaft, if not formed integrally with the handle, may be attached in a variety of methods including by use of a shank and adhesive or any method known in the art; the shaft may be formed integrally with the Versatile and Universal Handle or it may be detachable; the handle may be made out of a variety of materials including but not limited to wood, metal, and plastic, or any combination of these materials; the handle may be solid or hollow; if the handle is hollow, the hollowed out portion of the handle may include a telescoping rod which may be electronically controlled by exterior means; the handle may be made by carving, molding, or casting; the proximal end of the handle may be rounded, flattened, or otherwise modified without altering the gripping area; a strap or crook handle may be added for convenience in use and storage; the proximal gripping area may be slightly knurled to allow for better finger gripping; and an abutment, flange, or heel may be added in the vicinity of point of reference B0 as a means to add support for the hand. Accordingly, the present invention is not limited to the arrangements precisely as shown and described hereinabove.

What is claimed is:

1. A long cane, staff, or probe having a handle suitable for alternate or reverse gripping, comprising:

an elongated shaft; said handle intercoupled with one end of said shaft, said handle comprising:

(a) a proximal gripping area;

(b) an intermediate area; and (c) a distal area intercoupling said intermediate area and said shaft;

each said area having an axis defined therethrough;

said handle having a bilaterally symmetrical, curvilinear shape;

said axis of said proximal gripping area making an angle of between eight degrees and fifteen degrees with respect to said axis of said intermediate area;

said axis of said intermediate area making an angle of approximately one degree to five degrees with respect to said axis of said distal area;

said proximal gripping area of said handle having a cross-section of the outer end of the proximal gripping area which is substantially oval, with a transition within the proximal gripping area to a substantially circular cross-section of the central portion of the proximal gripping area, and a further transition to a substantially oval cross-section of the central portion of said intermediate area; and whereby the handle when firmly gripped in the forward or reverse orientation and manipulated promotes correct posture and ergonomically correct patterns of movement for a variety of tasks.

2. A long cane, staff, or probe having a handle suitable for alternate or reverse gripping, as defined in claim 1 wherein said handle is approximately 12.5 inches long and further comprises:

(a) a proximal gripping area measuring approximately 5 inches;

(b) a intermediate area measuring approximately 5 inches; and (c) a distal area measuring approximately 2.5 inches.

3. A long cane, staff, or probe having a handle suitable for alternate or reverse gripping, as defined in claim 1 wherein said angle of approximately eight degrees to fifteen degrees is approximately 11.25 degrees.

4. A long cane, staff, or probe having a handle suitable for alternate or reverse gripping, as defined in claim 1 wherein said angle of approximately one degree to five degrees is approximately 2.75 degrees.

5. A long cane, staff, or probe having a handle suitable for alternate or reverse gripping, as defined in claim 1 wherein said shaft is a long cane.

6. A long cane, staff, or probe having a handle suitable for alternate or reverse gripping, as defined in claim 1 wherein said shaft is a mobility device.

7. A handle and tool assembly suitable for alternate or reverse gripping, comprising a handle and a tool:

said handle comprising:

a proximal gripping area;

an intermediate area; and a distal area;

said distal area including means for intercoupling said intermediate area and [a] said tool;

said proximal gripping area making an angle of between eight degrees and fifteen degrees with respect to said intermediate area;

said intermediate area making an angle of approximately one degree to five degrees with respect to said distal area;

said handle having a bilaterally symmetrical, curvilinear shape of predetermined proportions; and the approximate ratio of height to width of said proximal gripping area at:

an outer end thereof is one and one-third:

a central portion thereof is one and one-fifteenth; and an inner end thereof is one and one-tenth whereby the handle when firmly gripped in the forward or reverse orientation and manipulated promotes correct posture and ergonomically correct patterns of movement for a variety of tasks.

8. A handle and tool assembly for alternate or reverse gripping as defined in claim 7, wherein said angle or approximately eight degrees to fifteen degrees is approximately 11.25 degrees.

9. A handle and tool assembly for alternate or reverse gripping as defined in claim 7, wherein said angle of approximately one degree to five degrees is approximately 2.75 degrees.

10. A handle and tool assembly for alternate or reverse gripping as defined in claim 7, wherein said tool is an elongated shaft.

11. A handle and tool assembly for alternate or reverse gripping as defined in claim 7, wherein said tool is a long cane.

12. A handle and tool assembly for alternate or reverse gripping as defined in claim 7, wherein said tool is a mobility device.

13. A handle and tool assembly for alternate or reverse gripping as defined in claim 7, wherein said tool is a mechanical tool.

14. A handle and tool assembly suitable for alternate or reverse gripping, as defined in claim 7 wherein the proximal gripping area has a rounded outer end.

15. A handle suitable for alternate or reverse gripping, comprising:

(a) a proximal gripping area; and (b) an intermediate area;

said handle having a bilaterally symmetrical, curvilinear shape;

said proximal gripping area making an angle of between eight degrees and fifteen degrees with respect to said intermediate area;

said proximal gripping area of said handle having a cross-section of the outer end of the proximal gripping area being substantially oval, with a transition within the proximal gripping area to a substantially circular cross-section of the central portion of the proximal gripping area, and a further transition to a substantially oval cross-section of the central portion of said intermediate area; and whereby the handle when firmly gripped and manipulated promotes correct posture and ergonomically correct patterns of movement.

16. A handle suitable for alternate or reverse gripping, as defined in claim 15 wherein said angle of a approximately eight degrees to fifteen degrees is approximately 11.25 degrees.

17. A handle suitable for alternate or reverse gripping, as defined in claim 15 wherein said proximal gripping area measures approximately 5 inches and said intermediate area measures approximately 5 inches.

18. A handle suitable for alternate or reverse gripping, as defined in claim 15 wherein the proximal gripping area has a rounded outer end.

19. A handle suitable for alternate or reverse gripping, comprising:

a proximal gripping area having an outer end and an inner end;

said handle having a bilaterally symmetrical, curvilinear shape;

said proximal gripping area having a ratio of the height to width of said handle taken at substantially 12% of the length and from the outer end of the proximal gripping area is substantially 1.35, at substantially 25% of the length from the outer end of the proximal gripping area the ratio is substantially 1.19, at substantially 50% of the length from the outer end of the proximal gripping area the ratio is substantially 1.08, at substantially 75% of the length from the outer end of the proximal gripping area the ratio is substantially 1.06, and at the inner end of the proximal gripping area the ratio is substantially 1.10; and whereby the handle when firmly gripped and manipulated promotes correct posture and ergonomically correct patterns of movement.

20. A long cane, staff, or probe having a handle suitable for alternate or reverse gripping, comprising:

an elongated shaft;

said handle intercoupled with one end of said shaft, said handle comprising:

(a) a proximal gripping area measuring approximately five inches;

(b) an intermediate area measuring approximately five inches; and (c) a distal area intercoupling said intermediate area and said shaft and measuring approximately two and one-half inches;

said handle having a bilaterally symmetrical, curvilinear shape;

said proximal gripping area making an angle of between eight degrees and fifteen degrees with respect to said intermediate area;

said intermediate area making an angle of approximately one degree to five degrees with respect to said distal area;

said proximal gripping area of said handle having a cross section of the outer end of the proximal gripping area which is substantially oval, with a transition within the proximal gripping area to a substantially circular cross section of the central portion of the proximal gripping area, and a further transition to a substantially oval cross section of the central portion of said intermediate area; and the ratios of height to width of said handle taken at substantially the following distances from the outer end of the proximal gripping area are substantially: 1.35 at 0.6 inch, 1.19 at 1.25 inches, 1.08 at 2.5 inches, 1.06 at 3.75 inches, 1.10 at 5.0 inches, 1.12 at 6.25 inches, 1.11 at 7.5 inches, 1.11 at 8.25 inches, 1.11 at 10.0 inches, 1.10 at 11.25 inches, and 1.07 at 12.5 inches;

whereby the handle when firmly gripped in the forward or the reverse orientation and manipulated promotes correct posture and ergonomically correct patterns of movement for a variety of tasks.

21. A handle for alternate or reverse gripping, comprising:

(a) a proximal gripping area measuring approximately five inches; and (b) an intermediate area measuring approximately five inches;

said handle having a bilaterally symmetrical, curvilinear shape;

said proximal gripping area making an angle of between eight degrees and fifteen degrees with respect to said intermediate area;

said proximal gripping area of said handle having a cross section of the outer end of the proximal gripping area being substantially oval, with a transition within the proximal gripping area to a substantially circular cross section of the central portion of the proximal gripping area, and a further transition to a substantially oval cross section of the central portion of said intermediate area; and the ratios of height to width of said handle taken at substantially the following distances from the outer end of the proximal gripping area are substantially: 1.35 at 0.6 inch, 1.19 at 1.25 inches, 1.08 at 2.5 inches, 1.06 at 3.75 inches, 1.10 at 5.0 inches, 1.12 at 6.25 inches, 1.11 at 7.5 inches, 1.11 at 8.25 inches, and 1.11 at 10.0 inches;

whereby the handle when firmly gripped and manipulated promotes correct posture and ergonomically correct patters of movement.

* * * * *